US006481709B2

(12) United States Patent
Gombau et al.

(10) Patent No.: US 6,481,709 B2
(45) Date of Patent: Nov. 19, 2002

(54) DEVICE FOR THE LONGITUDINAL ALIGNMENT OF PLATE ELEMENTS WITHIN AN INFEED STATION OF A MACHINE WORKING THEM

(75) Inventors: Georges Gombau, Epalinges (CH); Patrick Lüscher, Cossonay (CH)

(73) Assignee: Bobst S.A. (CH)

( * ) Notice: Subject to any disclaimer, the term of this patent is extended or adjusted under 35 U.S.C. 154(b) by 57 days.

(21) Appl. No.: 09/794,840

(22) Filed: Feb. 27, 2001

(65) Prior Publication Data

US 2001/0020767 A1 Sep. 13, 2001

(30) Foreign Application Priority Data

Mar. 8, 2000 (CH) ..... 0448/00

(51) Int. Cl.[7] ..... B65H 9/04
(52) U.S. Cl. ..... 271/246; 271/245; 271/240
(58) Field of Search ..... 271/245, 246, 271/18, 104, 121, 124, 137, 167, 145, 264

(56) References Cited

U.S. PATENT DOCUMENTS 4,344,703 A * 8/1982 Nezu et al. ..... 271/245
4,353,540 A * 10/1982 Beery ..... 271/10.12
4,895,361 A * 1/1990 Fujii et al. ..... 271/245
4,957,285 A * 9/1990 Yamada ..... 271/126
6,011,948 A * 1/2000 Amano et al. ..... 271/245

* cited by examiner

*Primary Examiner*—Donald P. Walsh
*Assistant Examiner*—Jonathan R Miller
(74) *Attorney, Agent, or Firm*—Ostrolenk, Faber, Gerb & Soffen, LLP

(57) ABSTRACT

Device (1) for the longitudinal alignment of plate elements (2) within an infeed station of a machine working them. The aforementioned device is secured by two lateral brackets (9, 10) between which is settled a conveyor track for the said plate elements, comprising two plates (5, 6) folded downwise according to a line (7) non-perpendicular in the meaning of the shifting (3) of the said plate elements (2). The latter are moved downstream by means of at least two conveyor belts running around at least two pulleys (15, 16) secured between unmovable bearings (11–14) at the input of the said device. The device (1) has on its leading edge a protection plate (39) over which are flaps (30–32) movable and interdependent of a transverse shaft (24) connecting the leading edges of the two lateral brackets (9, 10). This shaft is moved by an alternate rotation between 0 and 45 degrees, synchronized with the production speed of the machine in order to allow the successive alignment of the said plate elements (2). It has as a characteristic to be linked and made of several segments (26–28) each one of them bearing one of the said flaps (30–32).

16 Claims, 3 Drawing Sheets

DEVICE FOR THE LONGITUDINAL ALIGNMENT OF PLATE ELEMENTS WITHIN AN INFEED STATION OF A MACHINE WORKING THEM

BACKGROUND OF THE INVENTION

The present invention concerns a device for the longitudinal alignment of plate elements within an indeed station of a machine working them for the packaging production. In such a machine, the plate elements or paper or cardboard sheets are successively taken from the bottom of a pile and brought flat towards a line of working stations such as printing stations, cutting and waste stripping stations, before being piled up again in a delivery station.

At the infeed, the sheets are stored on a pile supporting plate equipped with an automatic vertical shifting chain device, so that the upper end of the pile remains the same during the infeed of the sheets into the operating machine. Lifting suction cups take the sheets one by one from the top of the pile and carry them towards carrier suction cups. The carrier suction cups have a back and forth horizontal movement in order to carry each sheet towards a feed table where the plate elements can thus be arranged tilewise.

A way of carrying out each sheet conveyance from the input of the feed table to the first processing station is to jointly use driving belts and pressure rollers which allow maintaining the sheet on the conveyor belt and carrying it to the front of the first working station. Each sheet is then removed to the next stations by gripper bar chains.

The device related in this invention is useful at the infeed station, right before the infeed table. To ensure correct functioning of the machine, it is necessary, on one hand, to guarantee the correct alignment of the leading edge of each plate element introduced so that it is not slanted and, on the other hand, to keep step in the speed with which those elements which are laid on the feed table. This last condition defmes the longitudinal location of the sheet on the conveyor belt, that is its position in the way of its travelling, so that the gripper bar can catch it easily when it comes. This speed can be physically estimated by the existing space between two leading edges of two successive plate elements on the feed table. The setting of a device for the alignment of the leading edge of the sheet makes it possible to perform both these two conditions as this device is working in synchronism with the production speed of the machine.

A device allowing the longitudinal alignment of the sheets usually comprises a transverse shaft connecting, from end to end, the width of the feed table. This shaft is settled slightly below the highest level of the sheet maintained by the carrier suction cups. When it is vertically installed, a blade extending along the transverse shaft and secured to it is acting as a stop for the leading edge of the sheet and is allowing thus its alignment. The shaft being synchronized with the production rate of the machine, it is moved by a repetitive rotation from 0 to 45 degrees, so that the blade is acting as a flap alternatively in a closed vertical position, and in an open oblique position which allows in this last case the travelling of the sheet in the feed table.

Several devices of this kind are known up to date but a few of them consider a subordinate problem involved with the inital state of the sheets at the time they have to be introduced into the production machine. The organic paper or cardboard sheets used in the packaging industry are particularly sensitive to the ambient conditions under which they are dealed with or stored. The moisture rate of the ambient air is one of the main settings significantly acting on the mechanical, dimensional and especially geometrical specifications of the sheet. Although the sheet is initially flat, it will often curve itself due to the variations of the hygrometrical rate of the ambient for example, but also due to a printing left on one of its sides. This phenomenon of curving is usually called "warp" in this technical field. The warp is especially involved in the corrugated board sheets and is all the more present as the thickness of the sheet is large or as the quality of materials used in the two sides of the sheet is different; what is often the case for the corrugated packaging boards having a high printing quality. It is obvious that the phenomenon of warp does not mean inevitably a symmetrical defect compared to one of the two symmetrical axis of the sheet. It may occur in fact that the sheet shows a more significant curve in its left part that in its right part or inversely.

Using strongly warped sheets onto a production machine means various problems, particularly at the time of the infeed of the sheet into the feed table, but also during the alignment of the leading edge of the sheet right before its infeed. The sheet being usually seized by the suction cups in its middle, if we introduce a strongly warped sheet in the feed table it generates an inconvenience on lateral parts of the sheet which will be deemed to knock against the leading edge of the feed table. Indeed, if we consider the concave curve of the sheet, the edge of the side parts of these sheets is located right below the infeed level, which corresponds to the central part of the sheet held by the suctions cups.

To overcome this problem, one can use tablets arranged on the leading part of the feed table such as they were shown in the patent CH 651'807. Comprising plates or bars curved downwise, these tablets make easier the infeed of the badly curved leading parts of such a warped sheet.

However, if strongly warped sheets must be used, a flap such as the one previously described is always standing in the way of their travelling. The edge parts of these warped sheets will indeed knock against the lateral parts of the opened flap, while risking to turn down the corners of the sheet. To face this problem, one can reduce the length of the flap by keeping only its central part so that the leading edges of the warped sheet can then travel easily thanks to the lateral release thus granted. This solution requires a division of the flap in several removable parts or in a multiplicity of segments, removable if required.

However, this option reveals a few disadvantages which are, on one hand, an unsuitable reduced alignment limited to the central part of the sheet which refers to the importance of its warp and, on the other hand, an additional handling which is to be achieved in a reduced space not easy to deal with, requiring thus the use of auxiliary tools for the assembly and the dismounting of the flap. Knowing that the warp of piled up sheets on a pile supporting plate at the infeed station varies according to the height of the pile, this option will require within the operation phase, on one hand, a permanent control of the travelling of the sheets over the opened flap and, on the other hand, many repeated manual handlings intended to control the length of this flap according to the curving rate of the sheets. These several operations involve thus frequent stops of the machine which are increasing the production cost.

The shape of the lateral guides supporting the infeed of the sheet rather changes according to the maximum release which offers, in its lateral parts, the device for the longitudinal alignment of the sheet. This release is inversely egual to the space occupied by the lateral parts of the flap when this one is intended to be of the necessary improvement allowing the travelling of warped sheets. More important is the release at the edges of the flap, better could be the travelling of the sheets and stronger could be their warp. But, on the contrary, larger is the length of the path of the leading edge of the sheet against the flap, better will be the alignment of the sheet and smaller will be the lateral release.

Up to this day, the machine operator was constrained to find the suitable option for the particular condition of these two opposite reports, so as generating the repeated and non-convenient adjustments such as those abovementioned.

SUMMARY OF THE INVENTION

To solve this problem, the aim of this invention is, for attaining the longitudinal alignment of sheets, a device with universal joints from which the movable stop flap shaft can be of a shape adapted to the curve of the leading edge of the warped sheet. To this end, the device of this invention comprises a device for longitudinal alignment of plates within an infeed station of a machine for working the plates. Two lateral brackets have a conveyor track for plates between them comprised of two plates that are folded down according to a line that is not perpendicular with respect to the shifting of the plates. The plates are advanced by at least two separated conveyor belts which run around pulleys and the pulleys for the belts are secured between immovable bearings located toward the input of the device. A protection plate is disposed at the leading edge of the plate above which flaps are movable. A transverse shaft connects the leading or entrance ends of the lateral brackets, and the shaft is rotatable in alternative directions between 0° and 45° synchronized with the production speed of the machine to allow successive alignment of the plates. The shaft is comprised of several links, which are shaft segments joined at universal joints. Each of the segments carries a respective one of the flaps. The ends of the shaft are supported in movable bearings in the lateral brackets.

The advantages resulting from this invention are mainly involved in the fact that such a device allows on one hand to carry out an alignment of the sheet on its nearly entirely leading edge, for a range of sheets affected with a significant warp (up to 4 to 5%), symmetrical or asymmetrical. On the second hand, the device according to the invention is able to stay definitively in the infeed station thanks to its particular tendency allowing it to easily modify its shape in order to be adapted to the convex shapes of the warped sheets. Advantageously, no part must be added to or removed from the flap of the aforesaid device, and no auxiliary tool is necessary to its setting which allows significant saved time during the preparation of the machine in the case of a new work. Finally, owing to a lack of existence, the risk to lose some parts of the flap can be completely removed in this new concept.

With an aim of defining a few words of the described position and the orientation of some parts within the machine with reference to the present invention, one will speak of "operator's side" and "opposite operator's side" used as a reference to a side indicated with comparison to the longitudinal median axis of the machine. This option allows to avoid any confusion occurring with the conventional definitions left and right-hand side depending on the point of view of the observer. With the same idea, one will use the usual words "longitudinal" and "transverse" with references to the median axis of the machine whose position is determinded by the direction of the run of the plate elements. Finally, one will also specify that the words "upstream" and "downstream" are referring to the way of run of the plate elements of the machine in production.

BRIEF DESCRIPTION OF THE DRAWING

The invention will be better understood studying a by no means restrictive mode of realization and illustrated by the enclosed figures in which.

DESCRIPTION OF A PREFERRED EMBODIMENT

Figures 1, 2:
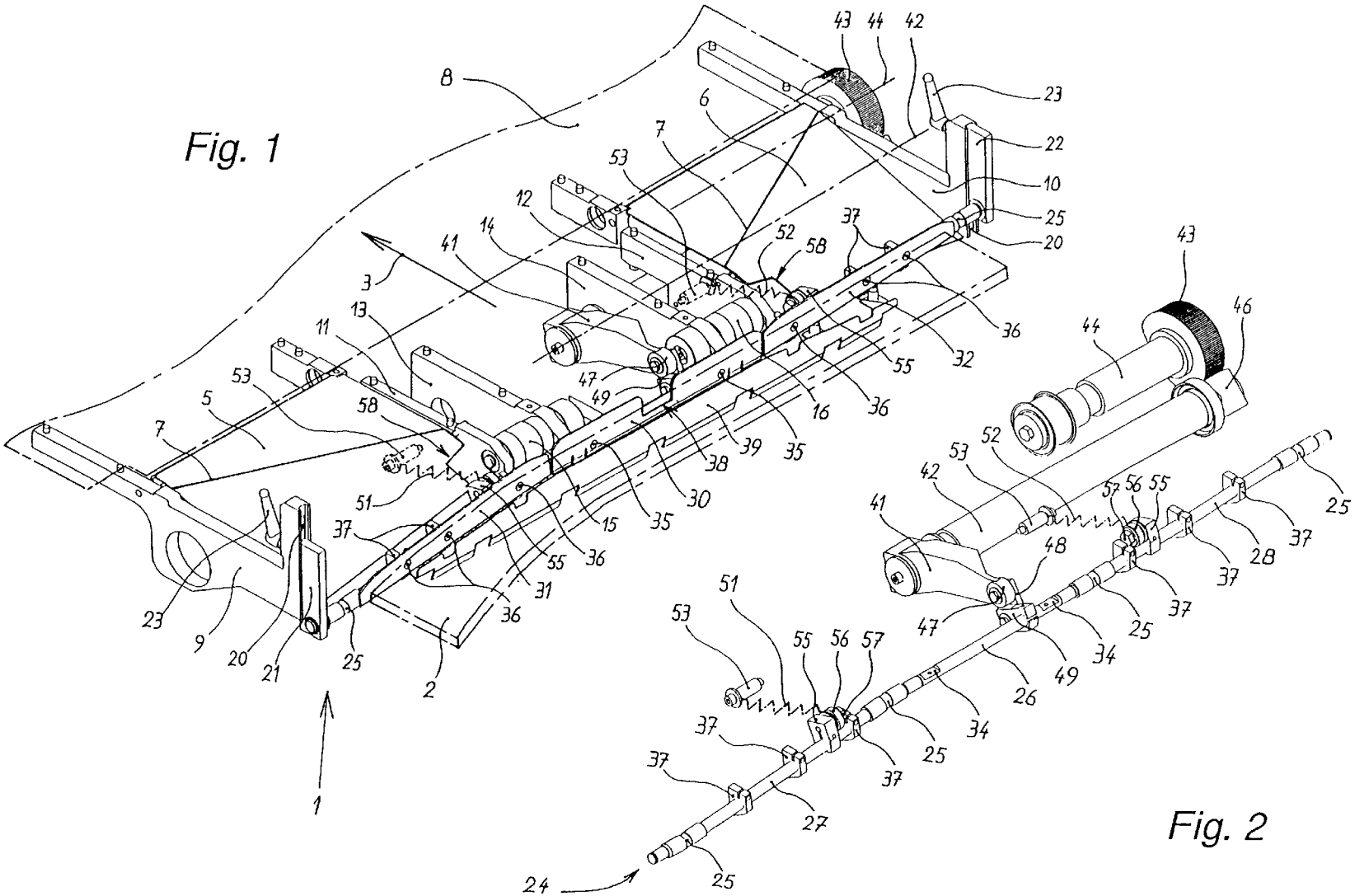
FIG. 1 is a perspective view of the device of the invention from the operator's side of the machine towards downstream, according to the travelling direction of the plate elements.
FIG. 2 is a perspective view of the mechanism illustrating the kinematic chain of the device of the invention from the same point of view.

FIG. 1 shows a global view of device 1 for the longitudinal alignment of plate elements 2, travelling according to the direction indicated by arrow 3 just located on the longitudinal axis of the machine. The plate element 2, illustrated in dotted lines, is only partially represented by its downstream part and comprises an asymmetrical warp whose curve is shown on the operator's side. Device 1 comprises two plates 5 and 6 downwards folded with an optimal angle and according to an oblique line 7, in order to ensure for the strongly warped plate elements two access tracks to a feeding table 8 schematically illustrated downstream with dotted lines. The exterior edges of plates 5 and 6 are respectively maintained against the lateral brackets 9 and 10 of device 1, and the interior edges are secured against two exterior bearings 11 and 12 fixed to the frame (not shown) of the packaging production machine. Two interior bearings 13, 14 are bearing jointly with the exterior bearings 11, 12, two pulleys 15, 16 in their upstream edge. Two conveyor belts 17, 18 (FIG. 3) turning around these pulleys allow to bring on the feed table 8 each plate element 2 successively infed into the packaging production machine.

Upstream, on the leading parts of the two lateral brackets 9 and 10, two bearings 21, 22 vertically moved down in guide-grooves 20, can be stopped there in an independent way one another thanks to the securing of a screw ended with a handle 23. A shaft 24 is settled between these two bearings and moved by four universal joints 25 easily identified on FIG. 2. This shaft 24 equipped with universal joints comprises three segments; that is to say two lateral segments 27 and 28 and one central segment 26 supported by bearings 13, 14. The vertical movings of bearings 21, 22 allow to easily modify, in a certain range, the incline of the lateral segments 27, 28 revolving around the two interior universal joints 25. Although this adjustment is carried out manually by means of handles 23, it is to be mentioned that it could be automated, even controlled, according to the importunate warp of the sheets which is likely to vary during all the production phase.

Each segment of the shaft equipped with universal joints is supporting a flap directed upstream towards the downstream leading edge of the plate element 2, so that the well aligned flaps 30, 31, 32 are forming a transversal plane stop for the longitudinal alignment of sheet 2. In FIG. 1, the flaps are shown in a known as closed position, that is to say in a vertical position so as to refrain the run of the plate element 2 and to form thus the alignment stop. The central flap 30 is secured back against the central segment 26 thanks to two supports 33 shown on FIG. 3. These supports are screwed up on the highest part of the central segment symmetrically compared to the longitudinal axis of the machine, on flat levels 34 obtained by milling (FIG. 2). The central flap 30 is finally secured against these supports using screws 35. The two lateral flaps 31 and 32 are secured against the respective segments 27, 28 by means of screws 36 crossing through and fixing clamps 37 regularly arranged on these segments.

The upper edges of the flaps are round-shaped, more especially on the exterior edges of the lateral flaps 31, 32, ensuring thus a maximal release for the run of a sheet with strong warp. The central flap 30 has an horizontal rectilinear upper edge, as well as an opening 38 afforded in this upper middle part. This opening allows the travelling of a luminous beam resulting from a non-illustrated sensor, arranged on the longitudinal axis of the machine downstream from the central flap. This sensor allows to regulate the height of the pile in accordance with the device allowing the longitudinal alignment of the sheets, which allows the infeed of only one sheet at a time on the feed table. The lateral flaps 31, 32 are similar and of a trapezoidal shape so that when setting their external end by means of the moving of the corresponding vertical bearings 21, 22, it is possible to align the upper edge of these flaps with the one of the central flap by defining thus a rectilinear horizontal line. This configuration is illustrated on FIG. 1 by flaps 30 and 32 operator's opposite side. The trapezoidal shape of these lateral flaps is also manufactured such as, when the height of their external edge is at the lowest level, their lower edge is parallel to the adjacent edge of a protection plate 39 secured by screws 40 (FIG. 3) to a non-illustrated embodiment connected to the frame of the machine. This second configuration is represented on FIG. 1 by flaps 30 and 31 operator's side, which correspond thus in shape to the protection plate 39 by reducing to the maximum the interstitial space.

FIG. 2 shows the mechanism defining the kinematic chain of the device of this invention. The positions held by the various illustrated elements are absolutely identical to those held by the same elements on FIG. 1. In order that the flaps of device 1 can be alternatively lowered intending to let free the run of plate element 2, and to raise so as to align the next element to come, it is necessary that the shaft 24 with universal joints is moved by this same movement ranging between a determined angular range, preferentially selected between 0 and 45 degrees towards the way of run of the plate elements. This alternate moving is controlled by a control pull rod 41 settled at the operator's side end of a transmission shaft 42. This latter is moved into rotation by the bearing 14 and by the lateral bracket 10 in which is another bearing. The alternate moving of the control pull rod 41 is provided by cam 43 secured on a shaft 44 which is continuously moved into rotation by a non-illustrated device, synchronized with the running speed of the plate elements.

Figure 3:
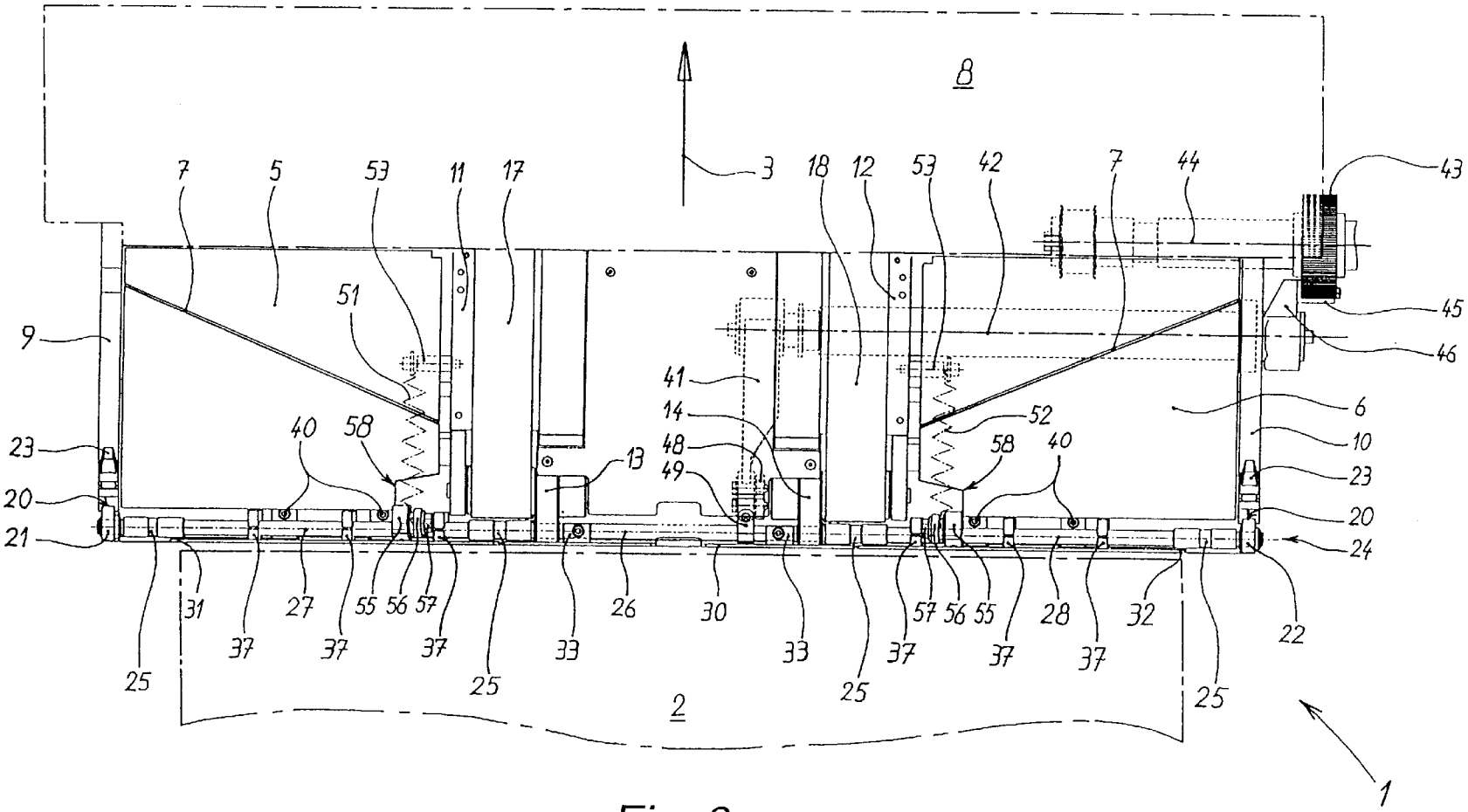
FIG. 3 is a top view of the device of the invention.
Figure 4:
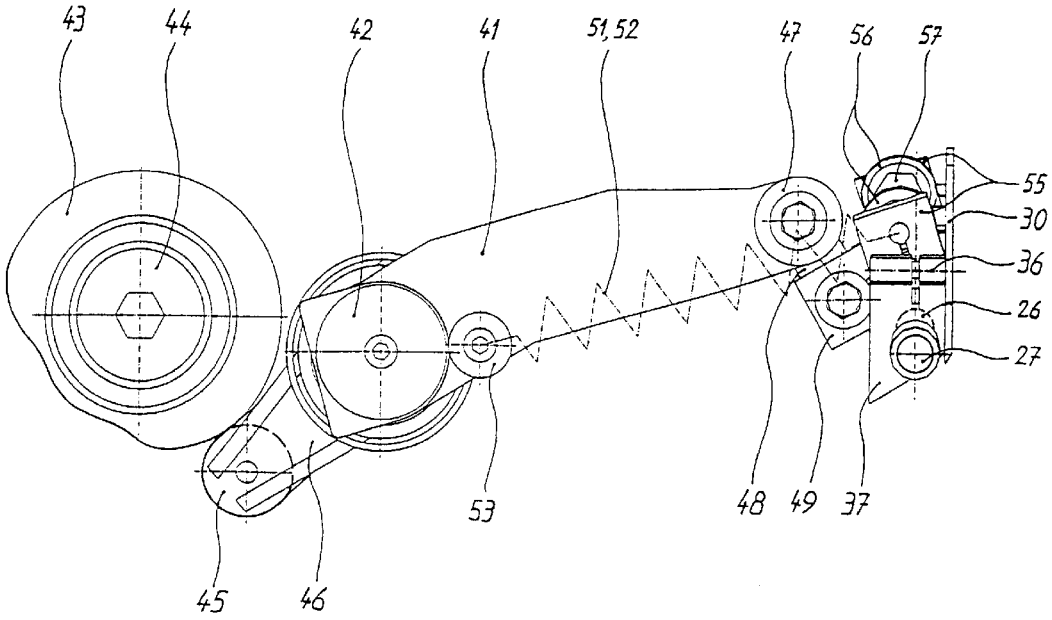
FIGS. 4 and 5 are side-faced views from the operator's side of the mechanism of FIG. 2, respectively when the flap stop is closed and when it is open.
Figure 5:
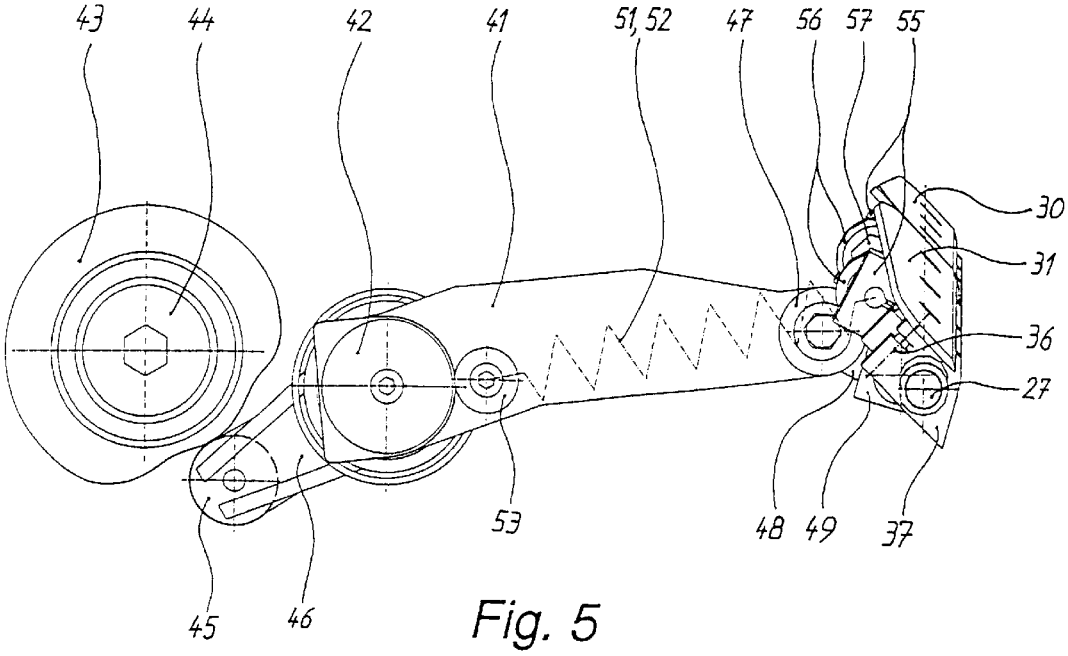

As it is shown in a more suitable way on FIGS. 3, 4 and 5, the particular shape of cam 43 is registered by a reading roller 45 secured to the end of shaft 46. The opposite end of this shaft is stongly attached to the final end, opposite operator's side, of shaft 42, so that the rotary moving of shaft 46 can be sent to the control pull rod 41. Ended by a link 47, the control pull rod 41 oscillates from an upper position to a lower position, and inversely, around the axis of the transmission shaft 42. A free rotation pull rod 48 is connecting the link 47 to the link 49 strongly secured on the central segment 26 of the shaft with universal joints. The pull rod 48 is performing as the central element of a transmission link acting on segment 26 of the shaft with universal joints, by inducing at one time and alternatively in one way and in the way back, which drives into rotation the whole shaft 24 so as to successively lower and raise the shafts 30, 31 and 32.

To compensate the variations in the kinematic chain and to ensure the controlling by a cam, two traction springs 51, 52 are respectively connecting the lateral segments 27 and 28 of the shaft with universal joints to the studs 53 strongly secured against the external side of bearings 11 and 12. The upstream end of these springs is secured on a bearing settled between one spring attachment 55 and one spacer 56 which are secured together by a screw 57. As it is better shown on FIG. 2, the spring attachment is attached, as the clamps 37 also, to the corresponding lateral segment of the shaft with universal joints. Two openings 58 provided in the plates 5 and 6 over the springs allow the latter to freely move.

FIGS. 4 and 5 are profile views of the mechanism of FIG. 2, from the operator's side, respectively when flaps 30, 31, 32 are in a closed position and when they are open. These two figures allow to better represent the movings of the bodies of the mechanism which act on the lowering and the raising of the shafts of the device, according to this invention.

Many improvements can be brought to the subject matter of this invention within the scope of the claims.

What is claimed is:

1. A device for longitudinally aligning plates to advance through an infeed station of a machine for subsequent working of the plates, the device comprising:

two separated lateral brackets;

an access track for the plates between the lateral brackets, the track being comprised of access track plates folded down with respect to the direction of advance of the plates over the access track;

two conveyor belts on which the plates may rest and the belts being movable to advance the plates; a respective pulley for each of the two conveyor belts moving the belts; a respective bearing for each of the pulleys at an entrance of the plates into the infeed station;

a protection plate at the entrance of the infeed station;

a transverse shaft extending between the lateral brackets and located generally at the entrance of the infeed station and above the protection plate; the shaft being rotatable as a unit in either one or an opposite direction synchronized with the moving speed of the belts;

the shaft having a plurality of segments therealong, a respective flap on at least some of the segments such that the rotation of the shaft selectively raises the flaps which block and align the plates and selectively lower the flaps which enables advance of the plates past the lowered flaps, the raising and lowering of the flaps being synchronized with the moving speed of the plates and for enabling successive alignment of the plates passing into the machine.

2. The device of claim 1, wherein the shaft is rotatable in opposite directions to respectively raise and lower the flaps.

3. The device of claim 2, wherein the rotation of the shaft is in the angle range of between 0° and 45°.

4. The device of claim 1, wherein adjacent ones of the segments of the shaft are connected to move with respect to each other such that the segments of the shaft are independently adjustable with respect to one another vertically for adjusting to the shape of the plates entering the infeed station.

5. The device of claim 4, further comprising universal joints connecting the adjacent segments of the shaft and connecting ends of the shaft to the lateral brackets, enabling segment adjustment.

6. The device of claim 4, wherein the bearings supporting the conveyor belt pulleys are immovable with respect to the lateral brackets.

7. The device of claim 6, wherein the bearings supporting the pulleys are immovable and are at such height that the upper edge of a respective flap thereat is about at the same level as the conveyor belt when the flap is in a vertical closed position and the flap is below the level of the conveyor belts when the flap is in an oblique open position.

8. The device of claim 6, further comprising movable bearings for the ends of the shaft at the lateral brackets and the movable bearings are independently adjustable with respect to one another in the vertical plane.

9. The device of claim 8, wherein the lateral brackets include vertical slide grooves and the movable bearings are slidable in the grooves for allowing the ends of the shaft to move along with the movable bearings over a range from a level located upward of the central segment of the shaft to a level located downward of the central segment of the shaft.

10. The device of claim 9, wherein the movable bearings are supported in the lateral brackets by a manually operable release screw connected with a handle for screwing tight each movable bearing in the respective guide groove therefor.

11. The device of claim 9, wherein the movable bearings are shiftable in the end brackets automatically via an actuator which is controllable according to the rate of warp of the plates being infed through the device to the machine working them.

12. The device of claim 11, wherein the lateral flaps have a trapezoidal shape so that when their exterior edges are located at a lower height level, they have a lower edge that is parallel to an adjacent edge of the protection plate.

13. The device of claim 9, wherein the flaps are in the same vertical plane when the flaps are raised into their so-called closed positions.

14. The device of claim 8, further comprising universal joints connecting the adjacent segments of the shaft and connecting the ends of the shaft to the movable bearings.

15. The device of claim 14, wherein the flaps on the segments of the shaft outward of the fixed bearings for the pulleys are similar and of trapezoidal shape and have outer edges that are adjustable by vertical shifting of the respective bearings at the ends of the shaft segments for setting the height of the outer edges for enabling aligning of the upper edges of the flaps at the outer segments with the flap on the shaft segment between the immovable bearings, thereby defining a horizontal rectilinear line and wherein the exterior universal joints at the lateral flaps are located at a level high than the level of the central segment of the shaft between the bearings.

16. The device of claim 1, wherein the flaps are rigidly attached to the shaft symmetrically with respect to the longitudinal axis of the machine.

* * * * *